US006688996B1

(12) United States Patent
Mitani

(10) Patent No.: US 6,688,996 B1
(45) Date of Patent: Feb. 10, 2004

(54) BASEBALL HOME PLATE WITH LASER BEAMS ARRANGEMENT

(76) Inventor: Shigeto Mitani, 14851 Jeffrey Rd., #60, Irvine, CA (US) 92618

( * ) Notice: Subject to any disclaimer, the term of this patent is extended or adjusted under 35 U.S.C. 154(b) by 0 days.

(21) Appl. No.: 10/321,148

(22) Filed: Dec. 18, 2002

(51) Int. Cl.[7] ..... A63B 71/02
(52) U.S. Cl. ..... 473/500
(58) Field of Search ..... 473/455, 499, 473/500, 456, 468

(56) References Cited

U.S. PATENT DOCUMENTS 1,868,088 A * 7/1932 Blair ..... 473/499
2,440,042 A * 4/1948 Friedman ..... 315/76
5,401,016 A * 3/1995 Heglund et al. ..... 473/476
5,676,607 A * 10/1997 Stumpf ..... 473/455
D478,953 S * 8/2003 Nobriga ..... D21/780

* cited by examiner

*Primary Examiner*—Mark S. Graham
*Assistant Examiner*—Nini F. Legesse
(74) *Attorney, Agent, or Firm*—Vladimir Khiterer

(57) ABSTRACT

A baseball home plate with laser beams arrangement is disclosed. The home plate has laser assemblies disposed along its edges emitting laser beams in the vertical direction. When a baseball thrown by a pitcher crosses over a path with one of the laser beams, the baseball is illuminated by a distinct laser spot. This permits an umpire to easily determine whether or not the baseball laterally passed through the strike zone and call the pitch a ball or a strike accordingly.

5 Claims, 4 Drawing Sheets

BASEBALL HOME PLATE WITH LASER BEAMS ARRANGEMENT

BACKGROUND OF THE INVENTION

The present invention pertains to a baseball home plate with laser beams arrangement. More specifically, this invention is a solution to the problem of accurately determining whether, in a baseball game, a pitch is a ball or a strike with respect to the home plate. Baseball fans know that a home plate umpire is charged with the duty of monitoring strike/ball calls at the home plate. A ball is a pitch which does not enter the strike zone, whereas a strike is a pitch that causes any part of the ball to pass through any part of the strike zone. Horizontally, the strike zone is the area over the home plate, while vertically, the strike zone consists of the area between the butter's chest and knees.

Specifically, from the umpire's vantage point behind the home plate, it is easy to see the height of a pitch. It is also not difficult to call a strike when a ball passes over the center of the home plate. The difficulty arises when a ball passes over the edge of the home plate. When this happens, it is not uncommon at baseball games to have disagreements as to whether the pitch is a ball or a strike.

SUMMARY OF THE INVENTION

The baseball home plate with laser beams arrangement solves the problem of disputed strike/ball calls by an umpire, in such cases. A polygon shaped baseball home plate has a plurality of laser assemblies disposed along its front and side edges. Each laser assembly comprises a top lens mounted flush with the upper surface of the baseball home plate, a laser diode and drive circuit controlled to emit a laser beam through the top lens in the vertical direction. There are provided two switches that can turn on and off two groups of laser beams. When a baseball thrown by a pitcher crosses over a path with one of the laser beams, the baseball is illuminated by a distinct laser spot. This permits an umpire to easily determine whether or not the baseball passed through the strike zone and call the pitch a ball or a strike accordingly. Further, if the game is taped, viewing the tape in slow motion will allow to see whether the baseball was illuminated by a distinct laser spot and resolve the doubt if there are conflicting claims of whether there was a ball or a strike. The baseball home plate of the present invention can also be used for pitching practice by allowing a pitcher to see whether a baseball thrown by the pitcher is illuminated by the laser spot or not.

BRIEF DESCRIPTION OF THE DRAWINGS FIGURES

DETAILED DESCRIPTION OF THE PREFERRED EMBODIMENTS

Figure 1:
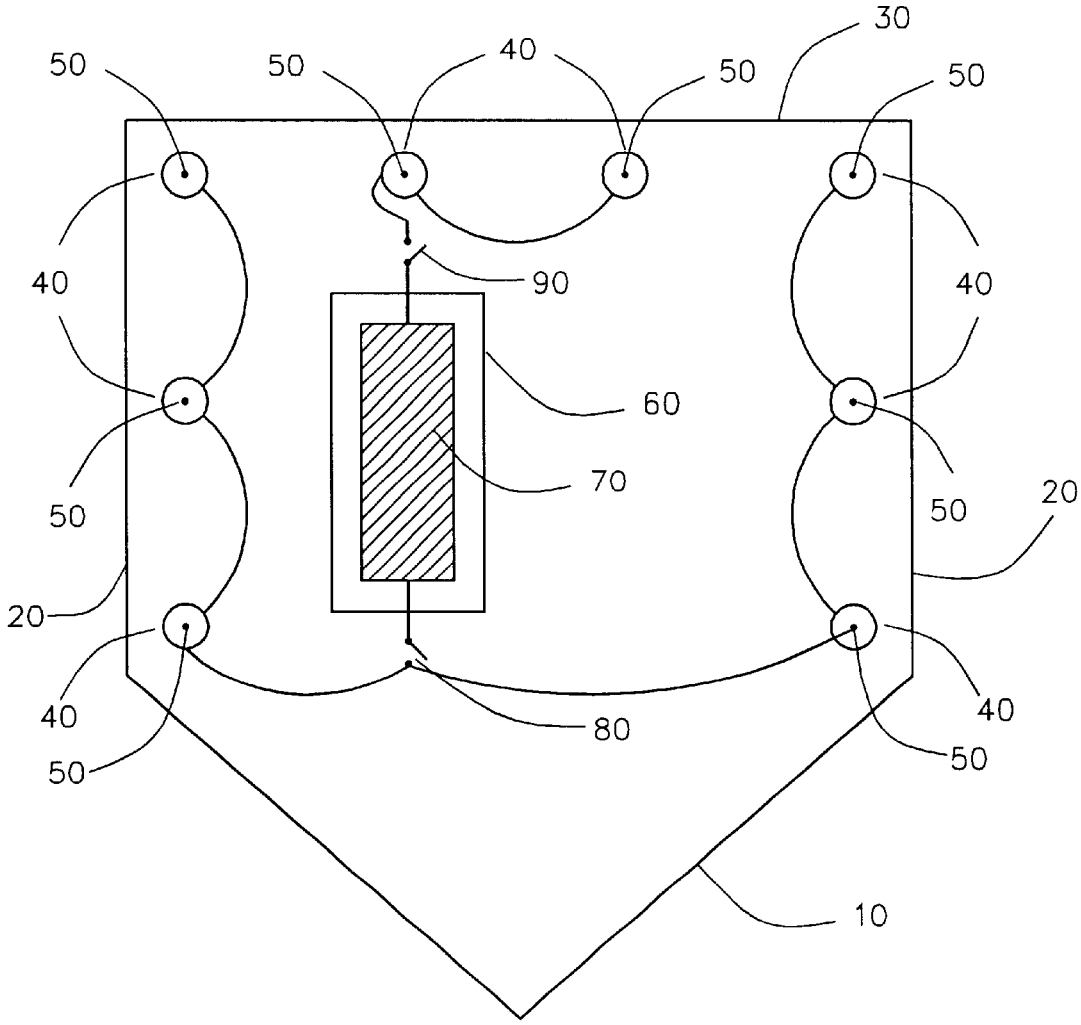
FIG. 1 shows top sectional view of the baseball home plate with laser beams arrangement of the present invention.

This invention will be better understood with the reference to the drawing figures FIG. 1, FIG. 2, FIG. 3 and FIG. 4. The same numerals refer to the same elements in all drawing figures.

Figure 2:
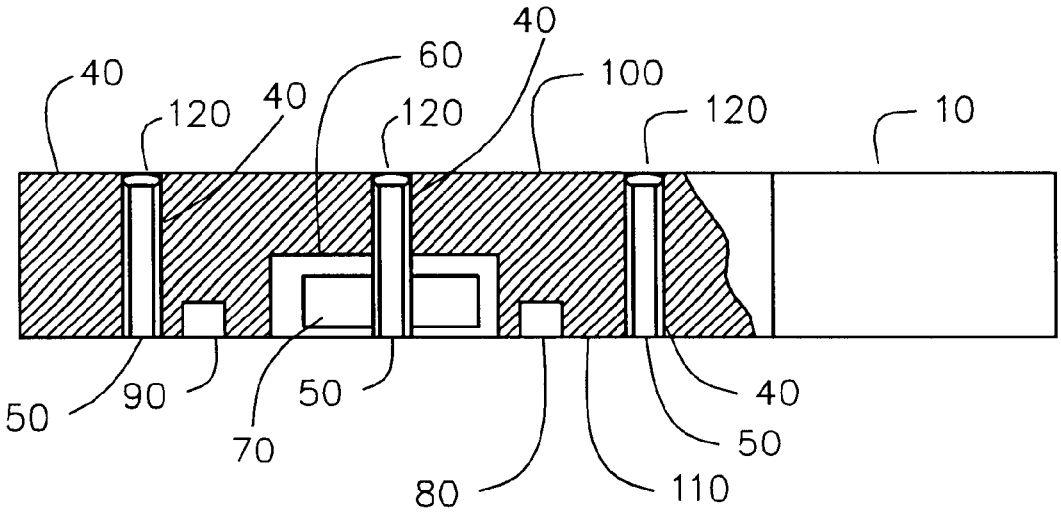
FIG. 2 shows a side sectional view of the baseball home plate with laser beams arrangement of the present invention.

Viewing simultaneously FIG. 1 and FIG. 2, numeral 10 indicates a baseball home plate. Baseball Home Plate 10 has a polygon shape and has an upper surface, indicated by numeral 100, mounted flush with the ground. Numeral 20 indicates side edges. Side Edges 20 are opposite and parallel to one another. Numeral 30 indicates a front edge. Front Edge 30 is perpendicular to Side Edges 20.

Numeral 40 indicates through passages. A plurality of Through Passages 40 is disposed along Side Edges 20 and Front Edge 30. Each of Through Passages 40 has an axis substantially perpendicular to Upper Surface 100. Numeral 50 indicates a laser assembly. One Laser Assembly 50 is fixedly mounted within each of Through Passages 40. Further, Through Passages 40 are shown as cylindrical bores. However, Through Passages 40 can be rectangular in shape, or any other shape suitable to accommodate Laser Assemblies 50 therein.

Each Laser Assembly 50 comprises a top lens indicated by numeral 120. Top Lens 120 is mounted flush with Upper Surface 100. Each Laser Assembly 50 also comprises a laser diode and drive circuit controlled to emit a laser beam through Top Lens 120 in the direction substantially perpendicular to Upper Surface 100.

Numeral 60 indicates a recessed chamber. Recessed Chamber 60 is disposed within a lower surface of Baseball Home Plate 10 indicated by numeral 110. Numeral 70 indicates a battery power source. Battery Power Source 70 is for providing electrical power to each of the drive circuits of Laser Assemblies 50. Battery Power Source 70 is removably mounted within Recessed Chamber 60.

Numeral 80 indicates a first switch. First Switch 80 is disposed within Lower Surface 110. First Switch 80 can be selectively placed in an on position and in an off position and is electrically connected to Battery Power Source 70 and to the drive circuits disposed along Side Edges 20. Placing First Switch 80 in the on position energizes the drive circuits disposed along Side Edges 20.

Numeral 90 indicates a second switch. Second Switch 90 is disposed within Lower Surface 110. Second Switch 90 can be selectively placed in an on position and in an off position and is electrically connected to Battery Power Source 70 and to the drive circuits disposed along Front Edge 30. Placing Second Switch 90 in the on position energizes the drive circuits disposed along Front Edge 30.

Figure 3:
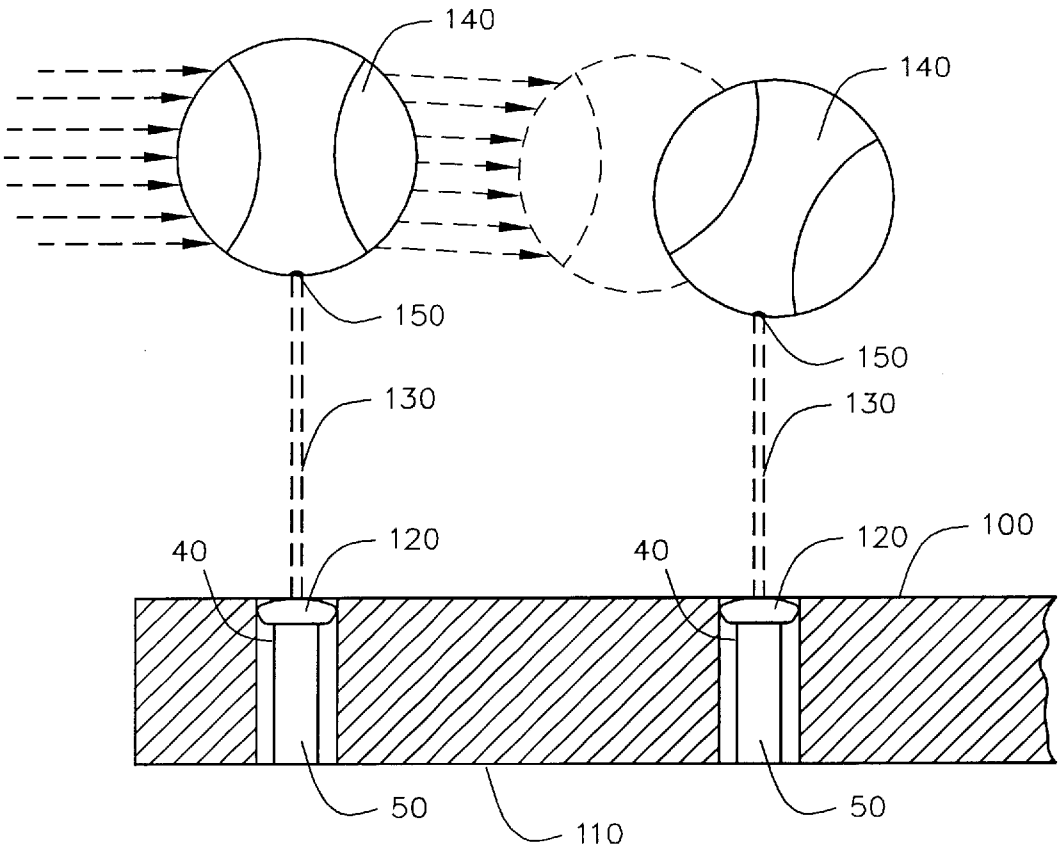
FIG. 3 shows an enlarged portion of the side sectional view of the baseball home plate with laser beams arrangement of the present invention.

Viewing now FIG. 3, numeral 130 indicates a laser beam. Laser Beam 130 is emitted by Laser Assembly 50 through Top Lens 120 in the direction substantially perpendicular to Upper Surface 100. Numeral 140 indicates a baseball. Baseball 140 is shown in FIG. 3 while crossing path with Laser Beam 130. This causes Baseball 140 to be illuminated by a distinct laser spot, indicated by numeral 150. Viewing Distinct Laser Spot 150 permits an umpire to easily determine that Baseball 140 has passed through the strike zone and call a strike accordingly. Because Baseball 140 is round, Distinct Laser Spot 150 appears on the arc of Baseball 140. Therefore, Distinct Laser Spot 150 is visible to the people viewing the pitch at and above eye level.

Top Lenses 120 and/or Laser Assemblies 50 or any part thereof can be replaced if damaged. Replacement may also be required in order to emit a broader, less intense Laser Beam 130. Emitting a broader, less intense Laser Beam 130 may be desirable for little league games where butters stand closer to Baseball Home Plate 10 and risk exposure by a more intense Laser Beam 130.

An alternative embodiment of this invention provides cushion means in order to protect Laser Assemblies 50 from shock caused by the impact between a baseball player and Baseball Home Plate 10, as well the impact caused by any other object coming into a contact with Baseball Home Plate 10. Cushion means protect the players as well. This embodiment is described in reference to FIG. 4.

Figure 4:
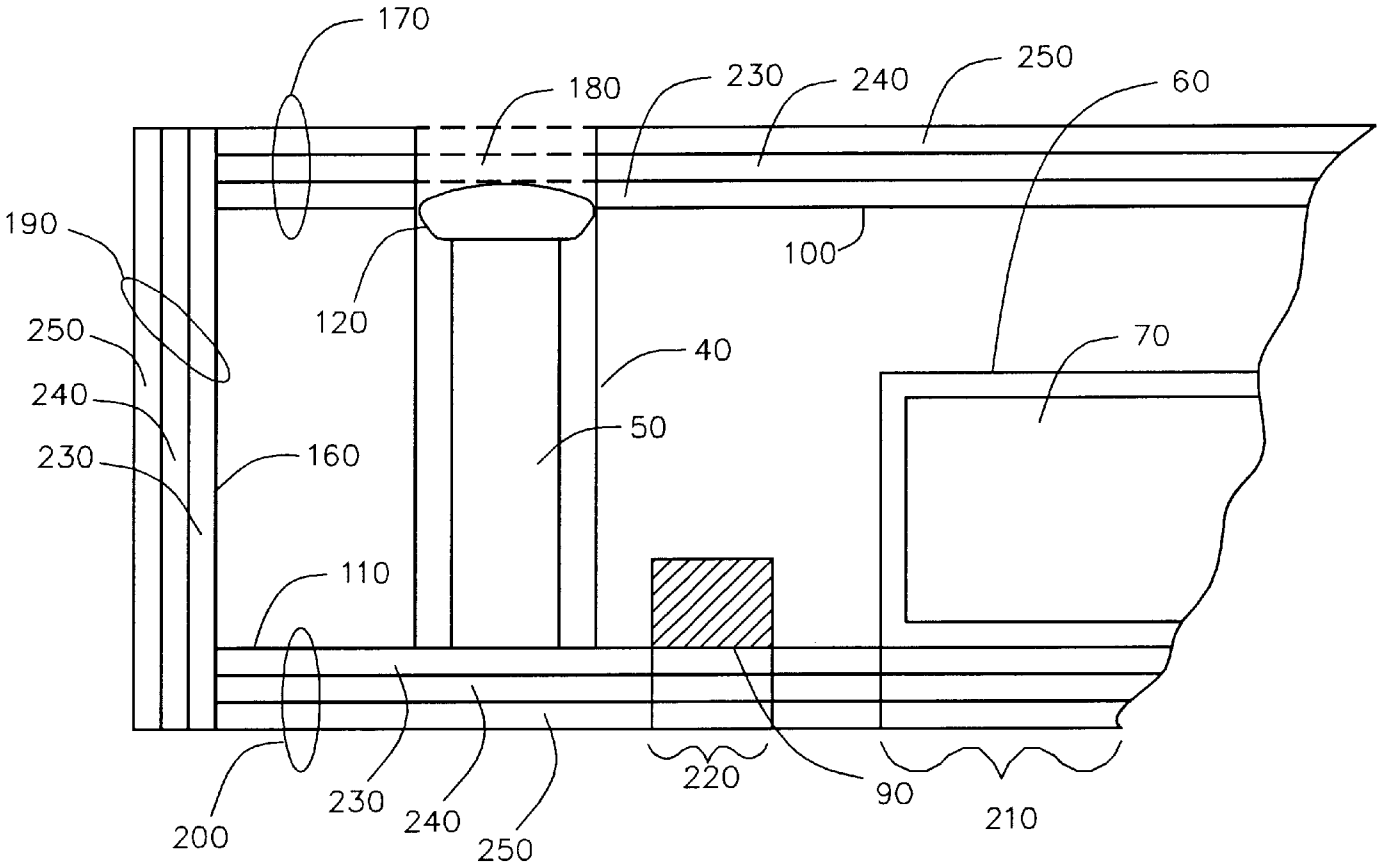
FIG. 4 shows an enlarged portion of the side sectional view of the baseball home plate with laser beams arrangement according to the embodiment comprising a cushion means.

Viewing now FIG. 4, numeral 160 indicates a side surface. Side Surface 160 is defined between Upper Surface 100 and Lower Surface 110 along the perimeter of Baseball Home Plate 10. Numeral 170 indicates a first cushion means. First Cushion Means 170 is disposed on Upper Surface 100 and it is affixed to Upper Surface 100 by way of adhesive or any other suitable means. Numeral 180 indicates an opening. First Cushion Means 170 comprises a plurality of Openings 180 that expose the corresponding Top Lenses 120 thus permitting Laser Beams 130 to pass through First Cushion Means 170.

Numeral 190 indicates a second cushion means. Second Cushion Means 190 is disposed on Side Surface 160 and it is affixed to Side Surface 160 by way of adhesive or any other suitable means.

Numeral 200 indicates a third cushion means. Third Cushion Means 200 is disposed on Lower Surface 110 and it is affixed to Lower Surface 110 by way of adhesive or any other suitable means. Third Cushion Means 200 comprises a means for access to the battery power source indicated by numeral 210, means for access to the second switch indicated by numeral 220.

Means for Access to the Battery Power Source 210 permits access to Battery Power Source 70 through Third Cushion Means 200 and can be done as a removable lid. Similarly, Means for Access to the Second Switch 220 permits access to Second Switch 90 through Third Cushion Means 200 and can also be done as a removable lid. Third Cushion Means 200 further comprises a means for access to the first switch (not shown in FIG. 4) which is identical to Means for Access to the Second Switch 220 and permits access to First Switch 80 through Third Cushion Means 200.

Further, each of First Cushion Means 170, Second Cushion Means 190 and Third Cushion Means 200 further comprises an inner layer indicated by numeral 230, an outer layer indicated by numeral 250 and a mid layer indicated by numeral 240. Mid Layer 240 is positioned between Outer Layer 250 and Inner Layer 230. Outer Layer 250, Mid Layer 240 and Inner Layer 230 are integrally bound to one another by way of an adhesive, a thermal process or any other suitable means.

Outer Layer 250 is comprised of a relatively rigid material. Suitable material for Outer Layer 250 is synthetic resin of a relatively hard nature, such as polyamide (nylon) or polyurethane or similar material.

Inner Layer 230 is comprised of a relatively resilient material having a first modulus of elasticity. Mid Layer 240 is also comprised of a relatively resilient material having a second modulus of elasticity. The first modulus of elasticity is higher than the second modulus of elasticity. This combination of the relatively rigid Outer Layer 250, resilient Mid Layer 240 and resilient Inner Layer 230 (Inner Layer 230 being softer or more elastic than Mid Layer 240) protects Laser Assemblies 50 from shock caused by the impact between various objects and Baseball Home Plate 10.

First Cushion Means 170, Second Cushion Means 190 and Third Cushion Means 200 can be replaced, when necessary, either entirely or only partially around desired locations on Baseball Home Plate 10.

The above-described preferred embodiment of the invention is exemplary only, and is not exhaustive of the scope of the invention. Specifically, this invention is not limited to the game of baseball and can be used for softball and other ball games. Consequently, the invention is intended to be limited only by the spirit and scope of the appended claims, giving full cognizance to equivalents in all respects.

What is claimed is:

1. A baseball home plate with laser beams arrangement, comprising:

(a) a baseball home plate of a polygon shape comprising an upper surface mounted flush with the ground and comprising two opposite parallel side edges and a front edge perpendicular to the side edges, a lower surface opposite to the upper surface, a side surface defined between the upper surface and the lower surface;

(b) a plurality of through passages disposed along the side edges and the front edge, each of the through passages having an axis substantially perpendicular to the upper surface;

(c) a plurality of laser assemblies fixedly mounted within each of the through passages, each laser assembly comprising a top lens mounted flush with the upper surface, a laser diode and drive circuit controlled to emit a laser beam through the top lens in the direction substantially perpendicular to the upper surface, such that a baseball crossing over a path with the laser beam is illuminated by a distinct laser spot;

(d) a recessed chamber disposed within the lower surface;

(e) a battery power source for providing electrical power to each of the drive circuits removably mounted within the recessed chamber;

(f) a first switch disposed within the lower surface that can be selectively placed in an on position and in an off position, the first switch being electrically connected to the battery power source and to the drive circuits disposed along the side edges, such that placing the first switch in the on position energizes the drive circuits disposed along the side edges;

(g) a second switch disposed within the lower surface that can be selectively placed in an on position and in an off position, the second switch being electrically connected to the battery power source and to the drive circuits disposed along the front edge, such that placing the second switch in the on position energizes the drive circuits disposed along the front edge.

2. A baseball home plate with laser beams arrangement as in claim 1, further comprising a first cushion means disposed on the upper surface, the first cushion means comprising a plurality of openings exposing the top lenses.

3. A baseball home plate with laser beams arrangement as in claim 2, further comprising a second cushion means disposed on the side surface.

4. A baseball home plate with laser beams arrangement as in claim 3, further comprising a third cushion means disposed on the lower surface, the third cushion means comprising a means for access to the battery power source, a means for access to the first switch and a means for access to the second switch.

5. A baseball home plate with laser beams arrangement as in claim 4, wherein each of the first, second and third cushion means further comprises an outer layer, an inner layer and a mid layer, the mid layer being positioned between the outer layer and the inner layer, said outer, mid and inner layers being integrally bound to one another, wherein:

the outer layer is comprised of a relatively rigid material;

the inner layer is comprised of a relatively resilient material having a first modulus of elasticity;

the mid layer is comprised of a relatively resilient material having a second modulus of elasticity, such that the first modulus of elasticity is higher than the second modulus of elasticity.

* * * * *